US005193431A

United States Patent [19]

Propsting et al.

[11] Patent Number: 5,193,431

[45] Date of Patent: Mar. 16, 1993

[54] DEVICE FOR OPERATION OF A SLIDING DOOR MEMBER

[75] Inventors: John R. Propsting, Greenwich; George D. Higgins, Beverly Hills, both of Australia

[73] Assignee: Parker-Hannifin Corporation, Cleveland, Ohio

[21] Appl. No.: 609,279

[22] Filed: Nov. 5, 1990

[30] Foreign Application Priority Data

Nov. 3, 1989 [AU] Australia ..... PJ7228
Apr. 24, 1990 [AU] Australia ..... PJ9764

[51] Int. Cl.[5] ..... F15B 15/26

[52] U.S. Cl. ..... 92/21 MR; 92/21 R; 92/53; 92/85 B; 91/41; 91/45

[58] Field of Search ..... 92/85 B, 51, 53, 15, 92/27, 28, 21 R, 21 MR; 91/41, 44, 45

[56] References Cited

U.S. PATENT DOCUMENTS 3,359,862 12/1967 Modrich ..... 92/28
4,296,679 10/1981 Mattsson ..... 92/53
4,524,676 6/1985 Rogers ..... 92/27
4,777,867 10/1988 Severinsson et al. ..... 92/21 MR
4,784,037 11/1988 Fabyan et al. ..... 91/44
4,854,223 8/1989 Fink ..... 92/21 MR

FOREIGN PATENT DOCUMENTS 1259011 3/1960 France ..... 92/51

*Primary Examiner*—Edward K. Look
*Assistant Examiner*—Hoang Nguyen
*Attorney, Agent, or Firm*—Christopher H. Morgan

[57] ABSTRACT

A device for operation of a sliding door member, the device being movable between an open position in which the door member is open and a closed position in which the door member is closed. The device includes a pneumatic cylinder having an actuating piston and a rod assembly. A slidable cage sealingly sleeved between the cylinder and the piston reduces the force applied to the piston rod when approaching the open position. When moving towards the first position force is provided initially by conjoined movement of the piston and said cage, and finally by the piston only. A latch for locking the device in the closed position is provided by a spear secured to the piston and rod assembly and a pin to lock the spear disposed in the cylinder. A manual delatching can be achieved by a cable operated spool which moves the pin to unlock the spear.

9 Claims, 6 Drawing Sheets

DEVICE FOR OPERATION OF A SLIDING DOOR MEMBER

BACKGROUND OF THE INVENTION

1. Field of the Invention

The present invention relates to a device for operation of a sliding door member.

2. Description of the Prior Art

The invention has been developed primarily for application to Suburban Train Doors and will be described with reference to this particular application. However, it will be appreciated that the invention is not limited to this particular field of use.

The train doors to which this invention applies are of the type comprising two planar door members disposed in the closed position in edge to edge abutment, which are slid apart in the same plane during opening. Each door member requires an individual operating device usually utilizing a push stroke to open, and a pull stroke to close.

The requirements of a suitable operating device include the ability to lock the doors in the closed position whilst the train is in motion. Most importantly a "soft nose" closing stroke is also required, whereby the closing force is reduced over the last part of the stroke to prevent crushing people or objects that may be trapped between the closing doors. In most applications it is also advantageous that any locking device can be manually overridden to unlock the doors if the train air supply falls below a minimum safe running pressure.

The "soft nose" stroking has hitherto been achieved by use of mechanical and air cushion springs, requiring a hollow piston rod to house such devices. However, such designs preclude the use of conventional latching methods.

It is an object of the present invention to provide a device for operation of a sliding door member which will overcome or substantially ameliorate at least some of the disadvantages of the prior art.

SUMMARY OF THE INVENTION

Accordingly, in a first aspect of the invention there is provided a device for operation of a sliding door member, the device being movable between a first position in which the door member is closed, and a second position in which the door member is open, the device including a pneumatic cylinder having an actuating piston and rod assembly, and means to reduce the force applied to the piston rod when approaching the first position, said means comprising a slidable cage sealingly sleeved between the cylinder and the piston, such that in use when moving toward the first position the force is provided initially by conjoined movement of the piston and said cage, and finally by the piston only.

Preferably the exhaust air from said cylinder is directed through a first port during conjoined movement of the piston and cage and through a second port during movement of the piston only, the second port being more constricted than the first port thereby cushioning the piston as it approaches said first position. In a preferred embodiment the second port is adjustable by inclusion of a needle valve.

Preferably also the device includes a first latching means for locking the device in the first position. In a first preferred embodiment the device further includes independently operable manual delatching means.

In a second embodiment the latching means includes biasing means to automatically unlock the actuating piston if the operating air supply falls below a predetermined pressure level. Preferably, an independently operable parking latch is included to lock the doors when not in use.

DESCRIPTION OF THE DRAWINGS

Preferred embodiments of the invention will now be described, by way of example only, with reference to the accompanying drawings in which.

DESCRIPTION OF PREFERRED EMBODIMENTS

Figure 1:
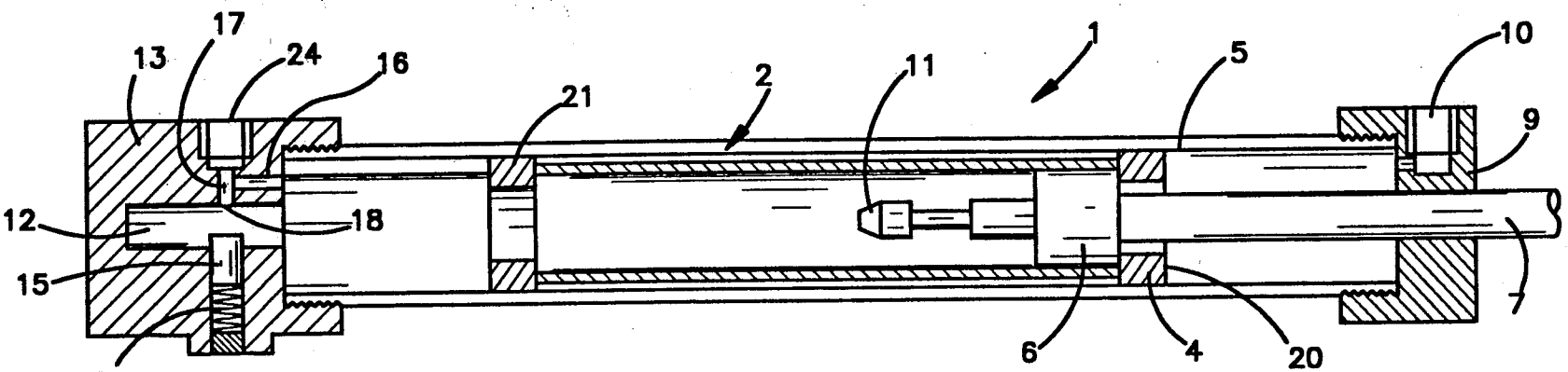
FIG. 1 is a schematic sectional side elevation of a door operating device according to the invention, shown in a position where the door is partially open.
Figure 2:
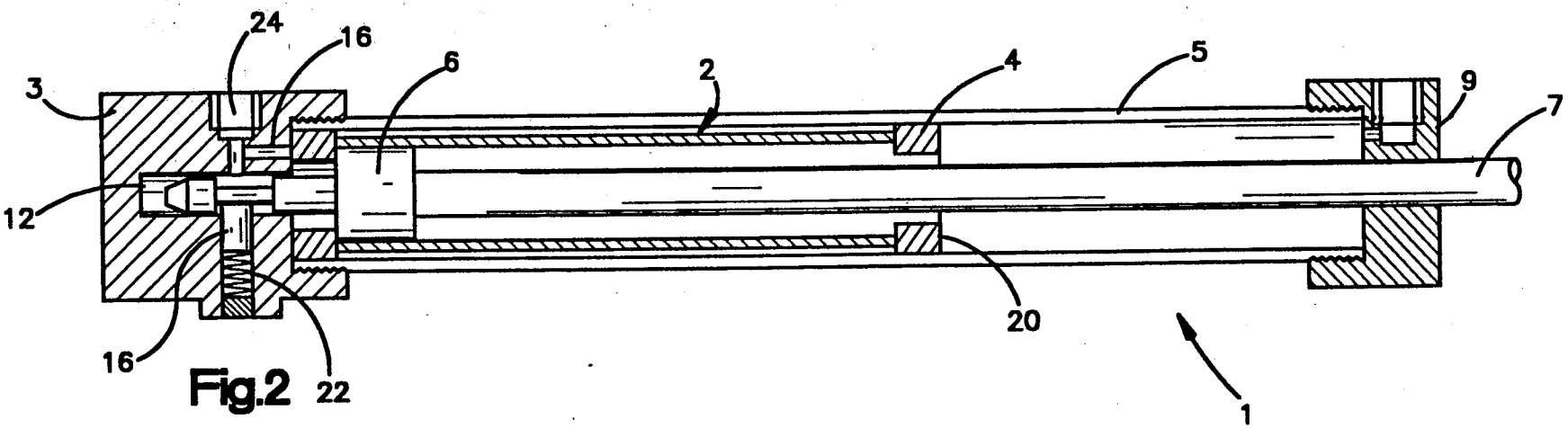
FIG. 2 is a view similar to FIG. 1 but showing the "door closed" position.

Referring initially to FIGS. 1 and 2 a device for operation of the sliding door member, according to this invention, is shown generally at 1. The device includes a pneumatic cylinder 2 having a latching device 3 at one end. A soft nose cage 4 is disposed within cylinder 2 to reduce the force at the end of the closing stroke.

Cylinder 2 comprises a substantially tubular outer body shell 5 housing an annular piston 6 which is fixedly secured to a piston rod 7. The cage 4 is sealingly sleeved between the shell 5 and the piston and rod assembly, and is captive about the piston 6. Where appropriate, seals are provided as will be seen in more detail in FIGS. 3 to 8.

The piston rod 7 extends axially from cylinder 2 terminating at its end distal to latching device 3, in a coupling (not shown) for attachment to a door member. A terminal block 9 is located at the end of shell 5 and provides an air inlet port 10. A spear 11 extends from piston rod 7 beyond piston 7 and toward the latch 3. The end of the cylinder adjacent terminal block 9 will hereinafter be referred to as the "head end" of the cylinder and the end adjacent the latch 3 will be termed the "cap end".

The latch 3 includes a block 13 in which is provided a first passage 12. Arranged transverse to and intersecting with the first passage is a second passage 14 which includes a locking pin 15. A first port 16 extends parallel to the first passage 12 providing an air flow passage from the cylinder to a second port 17. A restricted orifice 18 is provided at the intersection of the first passage with the second port 17. A flow control valve 19 (not shown) connects to second port 17 at 24.

In use, the device 1 is attached to the door by means of a coupling and supported from trunnion type mountings. A constant air supply is directed to inlet port 10 via a restrictor and non return valve (not shown), to provide a constant pressure head to the head end of the cylinder so as to keep the doors closed. When the air supply is applied to the cap end of piston 6, the resultant opening force becomes larger than the permanent closing force causing the door to open.

The area of the piston rod is designed to be approximately half the area of the cylinder bore and, by so doing, the opening and closing forces are approximately equal. When the door is open, the piston 6 rests against an end cap 20 of the cage 4 which in turn rests against the terminal block 9. The "door open" signal is then removed thereby exhausting air pressure from the cap end of the cylinder 2. This allows the permanent air supply at the head end from inlet port 10 to act simultaneously on piston 6 and the annular face of end cap 20.

As the area of the annular face of end cap 20 is larger than the area of main piston 6 and is not directly connected to the door, the cage will have a tendency to want to lead and to carry the main piston 6 with it. The closing force in this initial part of the stroke is then the additional force on the face of annular end cap 13 combined with the force on the main piston.

When the cage 4 fully strokes up against the block 13 of the latching device 3, the main piston 6 is left to stroke the remaining distance from end cap 20 to the opposite end cap 21 leaving only the minor (soft nose) force acting on the main piston 6 to fully close the door.

As the spear 11 enters the latch 3, its tapered leading edge displaces the locking pin 15 against a biasing force provided either mechanically or pneumatically at 22. When the tapered portion of the latch has traversed the locking pin 15 this pin snaps back up behind the spear 11 to trap it in the home position.

At the moment the cage 4 fully strokes against the block 13 there is a momentary pause in the closing action, as the closing force changes from full force to soft nose force due to the difference in piston areas. The resisting force on the latch side of the piston is controlled by the exhaust flow control valve 19 which takes a split second to bleed off sufficient pressure for closing motion to continue. The bleed rate through the exhaust control valve 19 is adjusted to the larger primary piston volumetric displacement. If applied to the smaller secondary piston displacement this would allow the closing speed to increase in proportion to the ratio of the two piston areas. This would then cause the two doors to slam together in the last couple of inches of closure, a situation which is not considered favorable.

In order to overcome this potential problem this embodiment introduces a secondary flow control over the length of the soft nose stroke. The principle of cutting off the main exhaust flow and directing it through an orifice (either fixed or adjustable by needle valve) is used to cushion the closing stroke.

Hitherto, cushioning in cylinders has been created by having a central cushion spear or sleeve on either or both sides of the piston the same length as the desired length of cushioning. When the cushion spear or sleeve enters the end plate of the cylinder it engages in a circular seal house in the end plate and blocks the main exhaust port which is located behind the cushioned seal. The trapped volume of fluid is then vented through an orifice running into the main exhaust port. The disadvantage of this method in long length cushioning is that the end plate must be at least as long as the cushion spear or sleeve, thereby making the cylinder unnecessarily long.

In order to eliminate this disadvantage, the embodiment uses the cage 4 to redirect the exhaust flow through a restricted orifice. When the cage 4 fully strokes against the block 13 the first port or main exhaust port 16 is sealed. As the piston 6 continues to close the exhaust flow is then forced through the orifice 18 before passing out through the exhaust flow control valve 19. The size of orifice 18 is designed to be more restrictive than the flow control valve 19 and therefore controls the closing speed over the soft nose stroke allowing the primary piston to close rapidly with full closing force until the secondary piston takes over. This allows both a soft nose closing force and a slow speed final closure which hitherto was only achievable by electrical door closing mechanisms such as in lifts and entrance doors for control of air conditioning.

Figure 3:
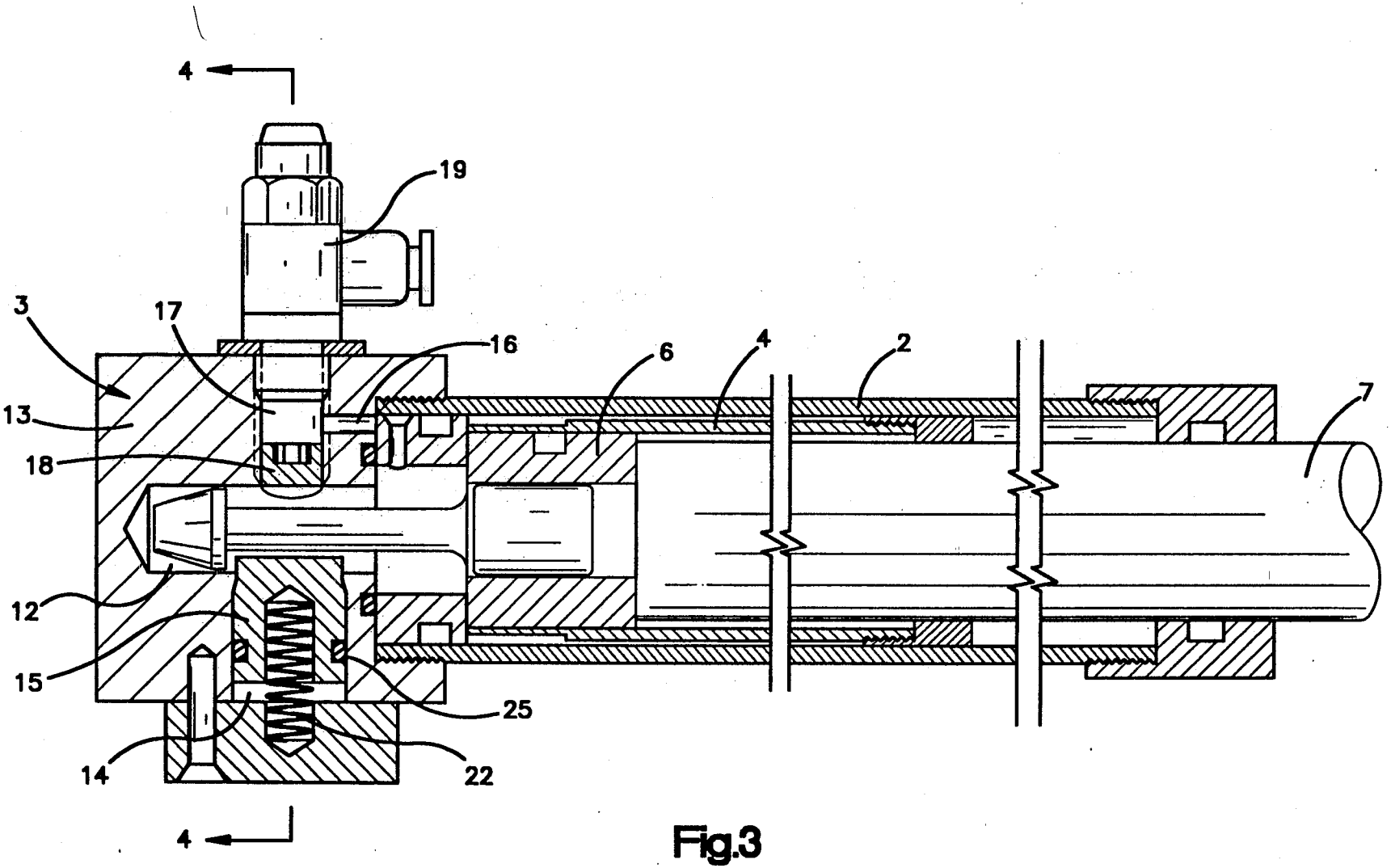
FIG. 3 is an enlarged detailed side elevation of the "soft nose" stroking device of FIG. 1 in combination with a first embodiment latching device.
Figure 4:
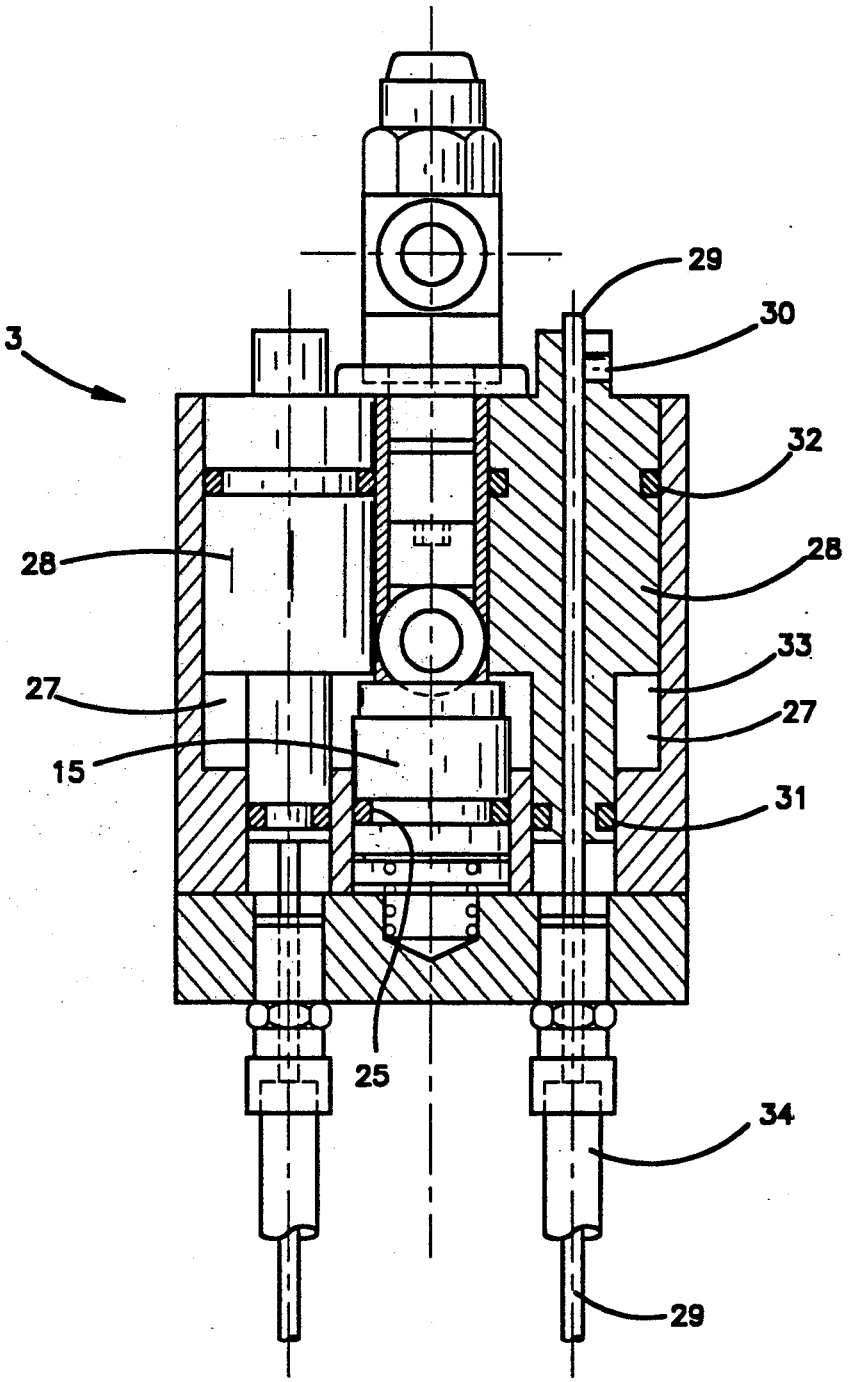
FIG. 4 is a sectional end elevation taken generally on line 4—4 of FIG. 3.
Figure 5:
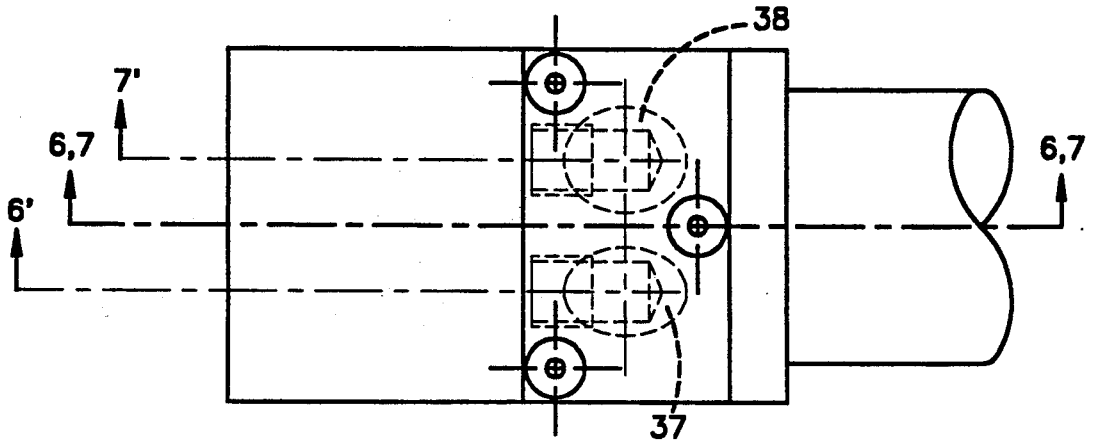
FIG. 5 is a plan view of a second embodiment latching device according to the invention.
Figure 6:
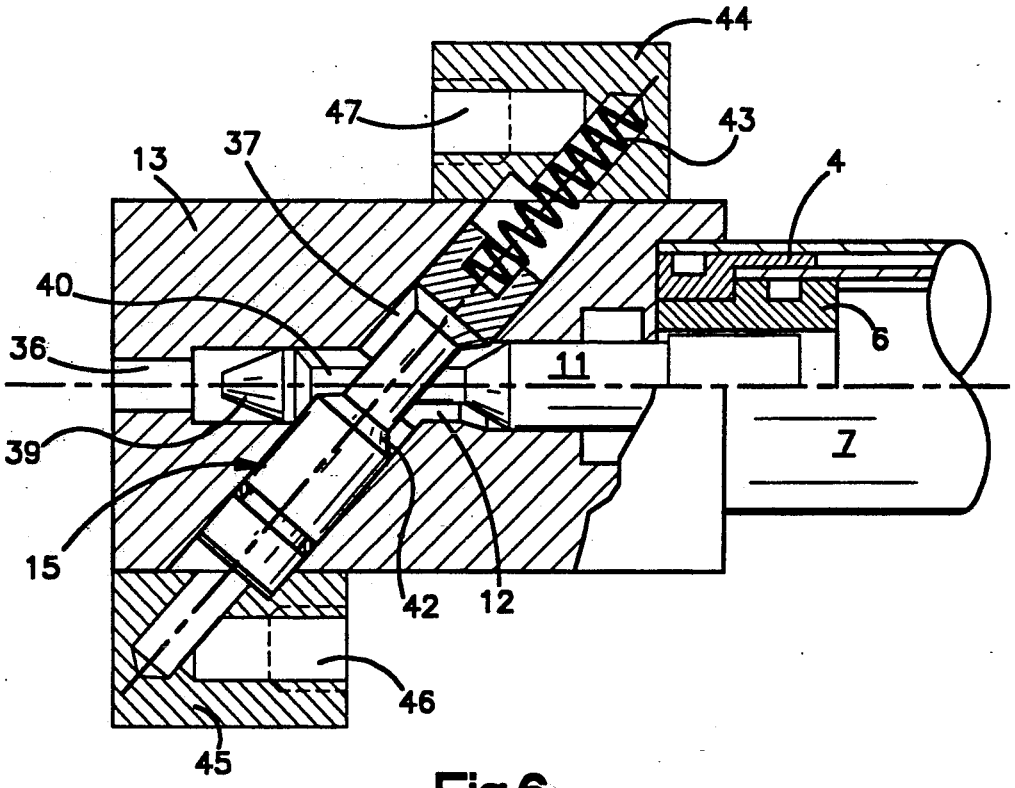
FIG. 6 is a sectional side elevation taken on lines 6—6 and 6'—6 of FIG. 5.
Figure 8:
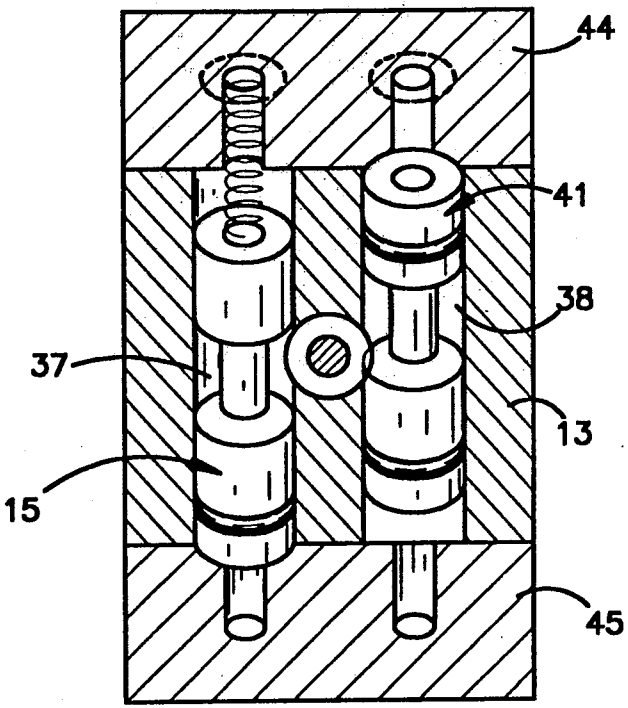
FIG. 8 is a sectional end elevation taken on line 8—8 of FIG. 7.

Referring now to FIGS. 3 and 4 there is shown in more detail the soft nose closing and cushioning devices connected with a first embodiment of the latching means according to the invention. Throughout the description corresponding reference numerals have been used to denote corresponding features.

In this embodiment of the latch 3 the locking pin 15 is sealingly slidable within passage 14 with the aid of an O-ring 25 seated in a corresponding ring groove provided in the peripheral surface of the pin 15. A helical compression spring 22 is seated within a bore provided in the pin 15 so as to bias the pin toward locking engagement with the spear. The compression spring is selected to be just strong enough to consistently overcome the friction between the O-ring seal 25 and passage 14. The orifice 18 is located in the second port 17 adjacent the first passage 12 and below the intersection with the first port or main exhaust port 16. Connected to the second port is the exhaust flow control valve 19.

Figure 9:
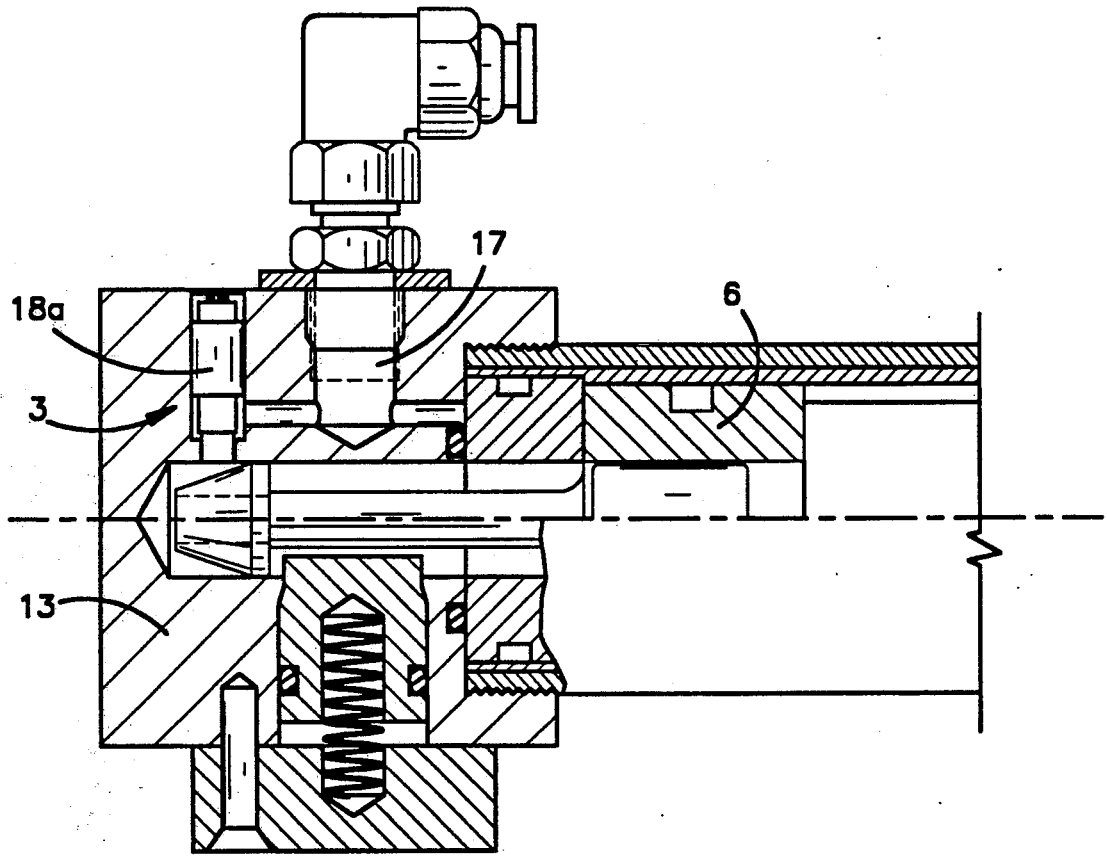
FIG. 9 is an enlarged fragmented side elevation of the "soft nose" stroking device as shown in FIG. 3 having an adjustable needle valve in the second port.

Referring briefly to FIG. 9 there is shown the same latch device with an alternative port configuration utilizing an adjustable needle valve 18A in replace of the fixed orifice 18 shown in the previous figures. This embodiment is preferred as it enables adjustment of the degree of cushioning required and allows fine tuning of the system at installation. Adjustments may also be required to take into account variations in door weights, closing speeds, etc.

Referring again to FIGS. 3 and 4 the block 13 includes two third passages 27 which partially intersect with opposite sides of the second passage 14. Provided within each passage 27 is a spool 28 with a "Bowden Cable" 29 threaded through its center and secured by a grub screw 30. One cable is operated from an internal location in the train car and other from an external location. They may be operated together or separately (which is the most likely possibility) without interfering with each other.

Each spool 28 is sealed with O-rings 31 and 32 whereby O-ring 31 is considerably smaller in diameter than O-ring 32. When either cable is actuated the corresponding spool is pulled down so that a spool shoulder 33 contacts the locking pin 15 and pulls it out of engagement with the spear 11. The friction of the two O-rings 31 and 32 in their respective passages 27 in addition to the friction of the cable 29 in the outer cable sheath is larger than the net closing force of the compression spring 22. This allows the spool 28 and locking pin 15 to remain depressed once the cable actuator has been released. When compressed air is again admitted to the cap both spools 28 and cables 29 are reset to the position shown in FIG. 4 by the pneumatic force on the surface of shoulder 33.

FIGS. 5 to 8 show a second embodiment of the latching means according to the invention. This embodiment provides for automatic delatching in the event of the air pressure falling below a predetermined pressure level. Its operation is similar to that of the first embodiment of the latch except that the locking pin is biased toward locking engagement with the spear by means of air pressure using an opposing compression spring to bias the pin out of engagement should the air pressure fail. The specific configuration of this latch and its operation will now be described in more detail.

In the locked position, as illustrated in the drawings, the piston 6 and cage 4 are at the end of the closing stroke in abutment with the latching device 3. The spear 11 extends axially into the first passage 12 in block 13 toward an air inlet port 36. Two angled second passages 37 and 38 traverse the path of the first passage 12 as shown.

The spear 11 has a frusto conical leading point 39 followed by a portion 40 of reduced diameter which then tapers outwardly again. Passages 37 and 38 each have an independent locking pin assembly. The locking pin 15, disposed in passage 37 forms the operating latch, and the second locking pin 41 in passage 38 is the stabling latch which is engaged when the train is not in use.

The locking pins 15 and 41 in both cases comprise a rod having an approximately central portion of reduced diameter with a taper 42 at each end thereof. Seals are effected between the pins and passages by use of O-rings in the usual manner.

The operating latch has a coil spring 43 seated in a blind hole in the uppermost part of the pin 15. Connector blocks 44 and 45 are provided in sealing engagement with block 13, connecting air ports 46 and 47 to passage 37, and air ports 48 and 49 to passage 38. The spring 43 extends upwardly through passage 37 into block 44 to connect with air port 47, thereby biasing the locking pin 15 in the downward unlatched position as shown.

As the piston 6 approaches the closed position, the spear passes into passage 12. As the spear enters the latch the conical leading pint 39 contacts the taper 42 of the locking pin 15 which is held up in the normal operation by air pressure at port 46 against the opposing spring pressure directed from port 47. The spring 43 is designed to provide a lesser force than the force from the air pressure at port 46. As the two conical faces 39 and 42 make contact, a force component is created down the axis of locking pin 15, which is maximized by the angle of the spool and in the choice of the conical angels. As this happens the combined forces of the spring 43 plus the force component down the axis of pin 15, moves the pin down allowing the spear 11 to pass through the latch until the conical faces disengage. At this time the pin 15 snaps back up behind spear 11 due to the air pressure that is in that port 46 trapping it in the home position.

When a "door open signal" is applied to ports 36 and 47 simultaneously, the force generated at port 47 is equal to the force present from the air supply to port 46 and the spring force takes control, displacing the locking pin 15 to a downward position as shown, allowing the door to open. In actual operation the door open signal is delayed momentarily to port 36, as it has to pass through a flow control valve. This is an advantage, allowing the spool pin 15 to move before the spear 11 starts to force against it.

The locking pin 15 may be disposed at right angles to the spear 11 or inclined as shown. The inclination of the spool pin 15 allows a larger component of the actual force directed to spear 11 to be utilized to help open the latch, which is particularly useful when the device incorporates the soft nose cushioning mechanism which reduces the force of the closing stroke.

Figure 7:
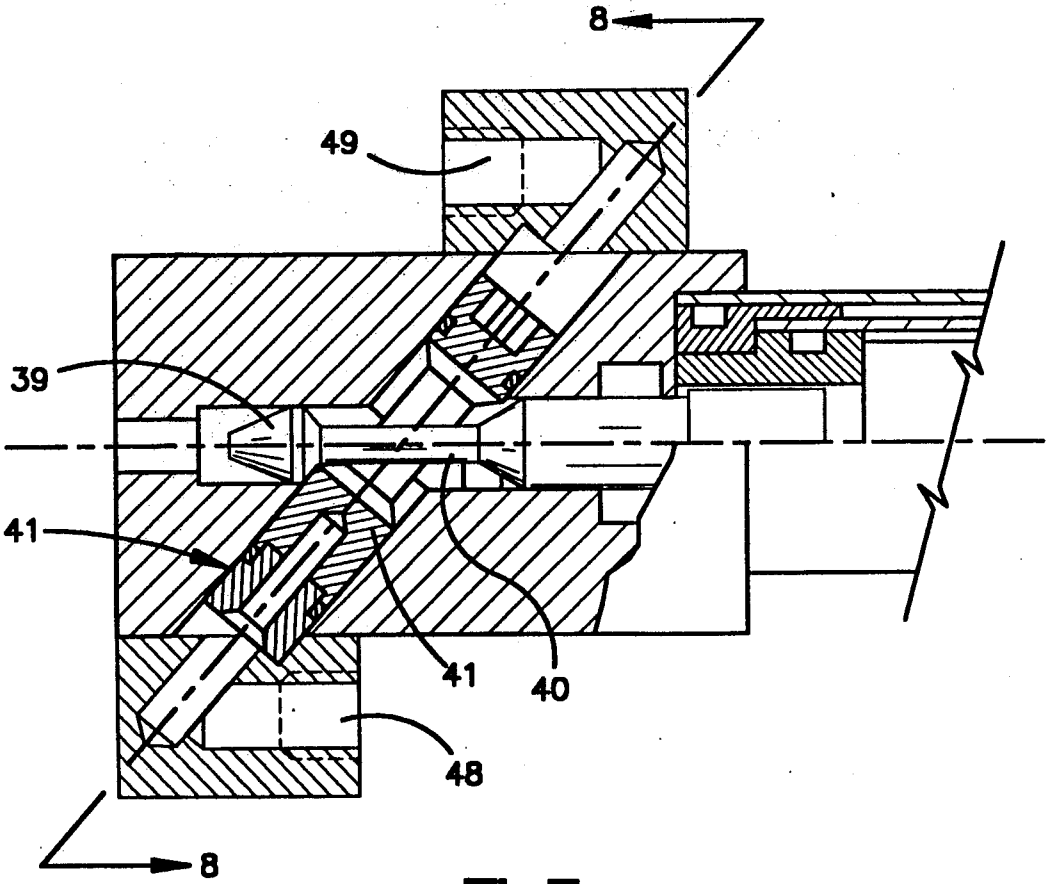
FIG. 7 is a sectional side elevation taken on lines 7—7 and 7'—7 of FIG. 5.

There is a further advantage in tilting the spool axis as shown. While attempting to open the door, the motion of the spear 11 creates a force component in line with the axis of the spool 15 which is directed upwardly forcing the spool 15 to lock even harder. This mechanism allows two separate latches, one on either side of the same spear 11, as illustrated in this embodiment, which can have different functions. The stabling latch is illustrated in FIG. 7 and is identical in its construction to the operation latch described, with the exception that there is no spring. The stabling latch is held open at all times during operation of the train by applying an air signal to port 49. This signal is maintained at all times during the running of the train. If the train air supply falls the stabling latch remains open by virtue of the check valves which are provided on the air intake side of the stabling valves which traps the air signals.

When the train is stabled, the guard or other authorized person walks through each car ensuring each door is closed and then activates the stabling valve driving the stabling locking pins 41 upwards and into engagement with the spear 11 thereby locking the doors. If the air supply should drop whilst the train is not in use, the locking pin 41 will remain in place by virtue of the check valve previously mentioned and any attempts to open the door will force the pin to lock even harder.

Although the invention has been described with reference to specific examples, it will be appreciated by those skilled in the art that the invention may be embodied in many other forms.

What is claimed is:

1. A device for operation of a sliding door member, the device being movable between a first position in which the door member is closed, and a second position in which the door member is open, the device comprising a pneumatic cylinder having an actuating piston and a rod assembly, means to reduce the force applied to the piston rod when approaching the first position, said means comprising a slidable cage sealingly sleeved between the cylinder and the piston, such that in use when moving towards the first position the force is provided initially by conjoined movement of the piston and said cage, and finally by the piston only; and including a first latching means for locking said device in said first position and an independently operable manual delatching means.

2. A device according to claim 1 wherein exhaust air from said cylinder is directed through a first port during conjoined movement of said piston and said cage and through a second port during movement of said piston only, said second port being more constricted than said first port thereby cushioning the piston as it approaches said first position.

3. A device according to claim 1 wherein said first latching means includes a spear having a locking recess and a tapered leading portion, the spear being fixedly secured to the piston and piston rod assembly, a first passage adapted to receive the spear, one or more second passages at least partially intersecting said first passage and having therein a pin and first biasing means applied to the pin so that as said spear moves along said first passage said tapered leading portion displaces the pin against said first biasing means which subsequently urges said pin back and into locking engagement with said locking recess.

4. A device according to claim 1 wherein said manually operated delatching means includes one or more third passages at least partially intersecting with said second passages having therein a cable operated spool movable between an inoperable and an operable position, said spool in said operable position cooperating with said pin to disengage it from said spear thereby unlocking the latch.

5. A device according to claim 4 wherein the frictional resistance between said spool and third passage in combination with the friction in the cable assembly is larger than the biasing force of said first biasing means applied to the pin thereby maintaining the latch in the unlocked position after the cable is released, the spool being returned to the inoperable position by application of high pressure air.

6. A device according to claim 3 wherein the first biasing means is in the form of pressurized air directed to the pin to urge it into engagement with the locking recess of the spear, said latching means including a second biasing means to automatically unlock the actuating piston if the operating air supply falls below a predetermined pressure level.

7. A device according to claim 6 further comprising an independently operable parking latch to lock the doors when not in use.

8. A device according to claim 7 wherein said parking latch is provided by one of said second passages containing a spool which selectively engages said spear by application of high pressure air to the spool, and a check valve for maintaining the spool in engagement should the air pressure drop.

9. A device according to claim 8 wherein said second passages intersect said first passage at an angle of less than 90°.

* * * * *